United States Patent [19]

Eckold et al.

[11] Patent Number: 4,614,017

[45] Date of Patent: Sep. 30, 1986

[54] DEVICE FOR JOINING METAL SHEETS BY A RIVETTING-TYPE METHOD

[75] Inventors: Gerd-Jürgen Eckold, St. Andreasburg; Hans Maab, Bad Lauterberg, both of Fed. Rep. of Germany

[73] Assignee: Walter Eckold GmbH & Co. KG, St. Andreasberg, Fed. Rep. of Germany

[21] Appl. No.: 438,095

[22] Filed: Nov. 1, 1982

[30] Foreign Application Priority Data

Oct. 28, 1981 [DE] Fed. Rep. of Germany ... 8131528[U]
Apr. 19, 1982 [DE] Fed. Rep. of Germany ... 8207848[U]

[51] Int. Cl.[4] ..... B23P 11/00

[52] U.S. Cl. ..... 29/243.53; 29/521; 72/465

[58] Field of Search ..... 29/238, 521, 522 R, 29/505, 566.1, 716, 509, 432, 243.5, 243.53, 432.1; 72/465, 363; 403/274, 283; 83/583

[56] References Cited

U.S. PATENT DOCUMENTS

| | | | |
|---|---|---|---|
| 2,288,308 | 6/1942 | Williams | 29/521 |
| 2,671,361 | 3/1954 | Sandberg | 29/432 |
| 2,688,890 | 9/1954 | Williams | 29/521 |
| 2,924,312 | 2/1960 | Williams | 29/521 |
| 3,130,489 | 4/1964 | Schlage | 29/521 X |
| 3,276,112 | 10/1966 | Tantlinger et al. | 29/522 X |
| 3,579,809 | 5/1971 | Wolf | 29/509 |
| 3,726,000 | 4/1973 | Hafner | 29/521 X |
| 3,729,804 | 5/1973 | Middleton | 29/521 X |
| 3,828,421 | 8/1974 | Erlichman | 29/526 X |
| 3,919,955 | 11/1975 | Du Vernay | 29/521 X |
| 3,993,428 | 11/1976 | Gumm et al. | 29/522 X |
| 4,130,922 | 12/1978 | Koett | 29/243.5 |
| 4,208,776 | 6/1980 | Schleicher | 29/243.5 |
| 4,306,511 | 12/1981 | Ashby et al. | 29/521 |
| 4,459,735 | 7/1984 | Sawdon | 29/509 |

FOREIGN PATENT DOCUMENTS

| | | | |
|---|---|---|---|
| 2344416 | 9/1973 | Fed. Rep. of Germany | 72/465 |
| 3106313 | 4/1982 | Fed. Rep. of Germany | 29/521 |
| 2073079 | 10/1981 | United Kingdom | 29/566 |
| 0732064 | 5/1980 | U.S.S.R. | 72/363 |

*Primary Examiner*—Gil Weidenfeld
*Assistant Examiner*—Glenn L. Webb
*Attorney, Agent, or Firm*—Cushman, Darby & Cushman

[57] ABSTRACT

A device is described for joining metal sheets with a male and female die, of the type in which the dies interact to cut or slice through the sheets to form portions of material which are spread via material flow by the die interaction to prevent separation of the sheets. The female die has plates which provide counter-edges which interact with the male punch to provide the desired cutting. The metal plates are leaf springs which yield after the cutting to permit spreading of the material.

24 Claims, 20 Drawing Figures

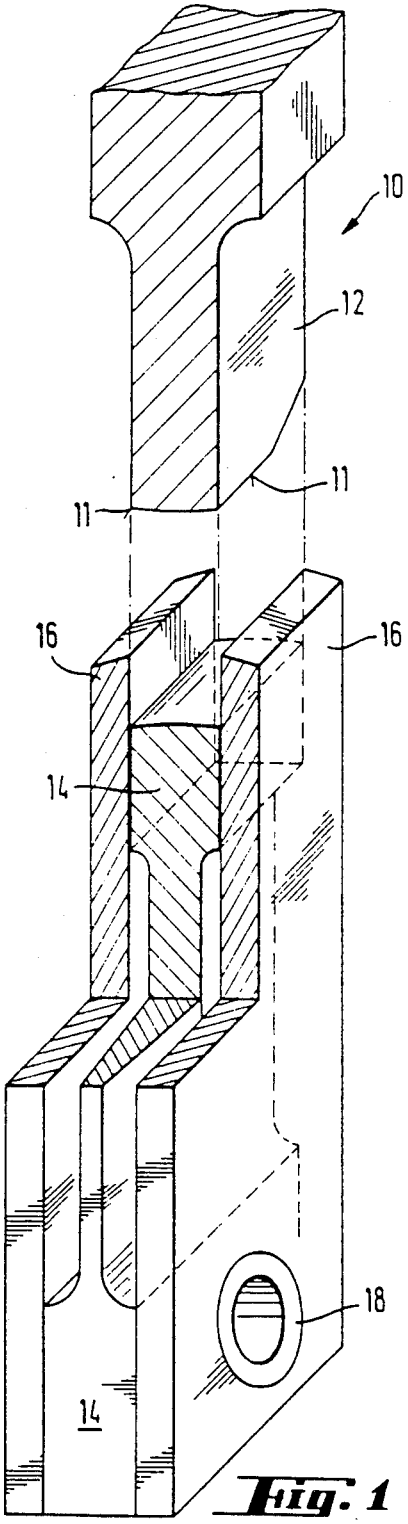
Fig. 1
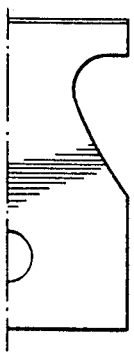
Fig. 2a
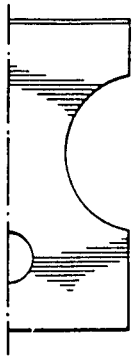
Fig. 2b
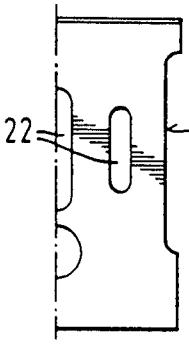
Fig. 2c
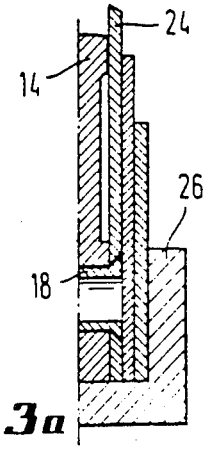
Fig. 3a
Fig. 3b
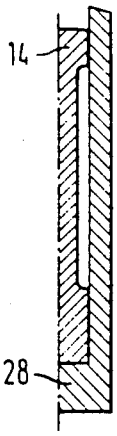
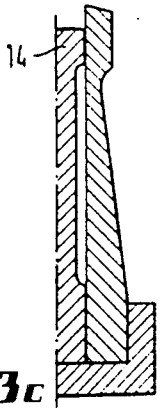
Fig. 3c

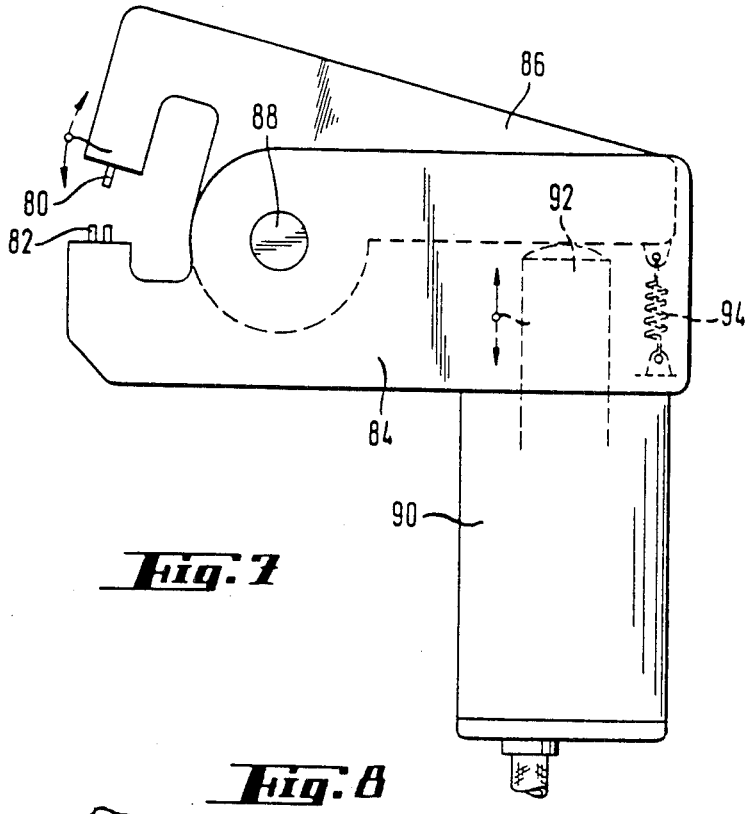
Fig. 7
Fig. 8
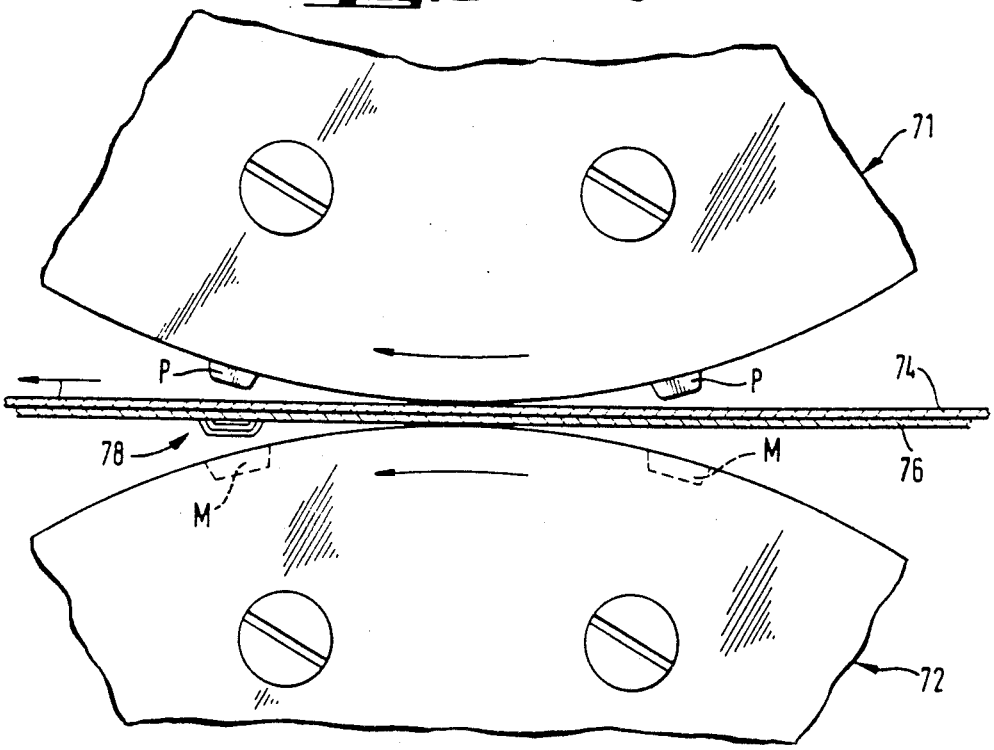

DEVICE FOR JOINING METAL SHEETS BY A RIVETTING-TYPE METHOD

BACKGROUND OF THE INVENTION

The invention relates to a device for joining metal sheets by a rivetting-type method utilizing mating dies in which the counter-edges provided by a female die are yieldable.

Such a device has been disclosed by German Offenlegungsschrift No. 3,106,313. In this device two levers carrying the counter-edges are arranged next to the anvil of the female die. The levers are pivotable about axes running transversely to the lifting direction of the press, and a helical compression spring acts on the two levers in such a way that they are biased into the cutting position in which they bear against the anvil. The linear distance of the two lever pivoting axes is greater than the distance of the two cutting edges of the punch.

A device of the same generic type has also been disclosed by U.S. Pat. No. 2,288,308. In this case, the female die comprises a plurality of components: a base; an anvil tapering towards its free end extends from the base; and counter-edge elements in the form of perforated steel plates supported on the base, bearing against the inclined side faces of the anvil. A bolt is also provided through a bore, on which spring discs acting on the outside of the steel plates are seated. The distance of the plate rims or counter-edges from the base on which the plates are supported and around which they tilt when yielding laterally, is thus greater than the distance of the cutting edges and counter-edges in the rivetting position.

The same comments apply to the embodiment according to U.S. Pat. No. 2,254,558; in the embodiment illustrated therein, the cutting edge bodies and the return leaf spring are integrally formed, angled off or bent off, and the cutting edge bodies are supported by the anvil.

In the known constructions described, it is found that, during the cutting through the two sheets, a force component directed inwards onto the anvil is exerted onto the components provided with the counter-edges—that is to say the levers or plates—which ensures that the counter-edges do not already yield laterally during the cutting-through phase.

On the other hand, however, this has the consequence that in the second phase of flow-pressing the counter-edges not only yield laterally but, during their yielding movement, also have a component which is directed towards the punch and which has a tendency to prevent the joint made from reaching that strength which ought to be possible under otherwise identical conditions. Moreover, chips could penetrate between the cutting edge components and the portions of the anvil supporting the former, whereby the usefulness of the entire device is put into question. It should be desirable, rather, that the elements provided with the counter-edges would move away precisely laterally.

This might perhaps be achievable constructionally by an appropriate sliding mount of the components provided with counter-edges and by springs acting perpendicular to the lifting direction of the press. This would, however, not only result in an expensive and complicated structure, but also in an even greater lateral extension of the female die than appears to be unavoidable even in the most modern known construction according to the German Offenlegungsschrift initially mentioned.

SUMMARY OF THE INVENTION

It is an object of the invention to provide a device of the type discussed above, in which an optimum joint is formed and in which moreover a simple construction permits inexpensive mass production and which, finally, can have minimum dimensions in the direction transversely to the lift of the press.

According to the invention, this is achieved when the counter-edges are formed by the free end rims or edges of leaf springs which extend parallel to the movement of the male die.

The resulting advantages are as follows:

The leaf springs are simple punched components and, since they extend parallel to the lift of the press, the anvil can also be a simple punched sheet metal component. The leaf springs fulfill three functions simultaneously: they provide the counter-edges, they transmit the cutting forces to a base and they provide the restoring force after the lateral yielding. The yielding takes place about an axis which is located almost precisely underneath the particular counter-edge, because the leaf springs used can be relatively thin. In fact, it has been found that the risk of the counter-edges yielding laterally during the cutting phase is fairly small even if the leaf springs are relatively thin. Not only the counter-edges of the leaf springs but—even though only to a very small extent—the entire surface which faces the punch penetrate into the sheet facing them, and they are therefore supported by the metal sheet itself against yielding.

However, since the leaf springs, as stated, can in fact be relativey thin, only a very small extension in the direction transversely to the lift of the press results.

Expedient and advantageous further developments of the subject of the invention are defined in the subclaims, and the resulting advantage will be stated each time in the particular context in the explanation of illustrative embodiments which follows.

BRIEF DESCRIPTION OF THE DRAWING

Reference is made here to the attached drawings in which:

FIG. 1 shows, in a partially cut, perspective view, a tool set which consists of a male die punch and a female die and which, together with the press, forms a device according to the invention;

FIGS. 2*a*–2*c* a side view of one-half of each case of the symmetrically formed leaf spring components of a female die in sections;

FIGS. 3*a*–3*c* show vertical sections of half female dies in each case in three embodiments a, b and c, modified as compared with FIG. 1;

FIG. 7 shows a complete device including a possible embodiment of the press;

FIG. 8 shows a partial view of a device in which the female dies and the male dies are fitted to revolving disks;

DETAILED DESCRIPTION OF PREFERRED EMBODIMENTS

Figure 4A:
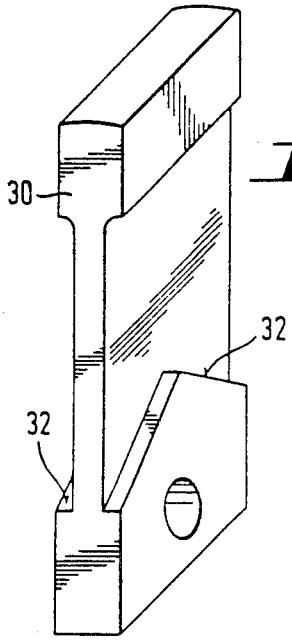
FIGS. 4*a*–4*c* show special forms of female dies and male dies in embodiments a, b, c, d and e.

FIG. 1 shows the male die 10 with its punch 12 which here has a rectangular cross-section with cutting edges 11 and can have a flat or slightly convex end face; its outline is preferably trapezoidal. The female die comprises the anvil 14 and two mutually identical counter-edge portions 16. The anvil and the counter-edge portions are captively joined to one another by, say, a hollow rivet 18. Within the zone of this joint, the three components are in flat mutual contact, and likewise in the end region facing the punch 12. In between, the anvil is recessed on the side facing the counter-edge portions, in such a way that it obtains an approximately rhomboid cross-section; the free spaces thus created make it possible that chips which may drop into this space can be removed to the outside, without impeding the springing back of the counter-edge portions. In operation, that side of the counter-edge portions which faces the anvil surfaces is supported in the foot region, where the rivet 18 is also located by, say, means of a screw (not shown) which extends through the rivet and fixes the female die to a holder which also supports the female die on the side facing away from the punch 12. In the region of their free end, the counter-edge portions can spring outwards.

While the shape of the anvil and of the punch in FIG. 1 is shown approximately realistically, the shape of the counter-edge portions drawn there is not the most advantageous. Better shapes are shown in FIGS. 2 and 3.

In fact, trials have shown that the life of the device is essentially determined by the alternating stresses on the counter-edge portions which are deflected during each working cycle. It is therefore preferred to shape these in such a way that the deformation is distributed as uniformly as possible over the free length—corresponding to the deflection of a beam, clamped in on one side, under a load on its end— the resulting profile being approximately that shown in FIG. 2*a*. In a simplified form according to FIG. 2*b*, the flanks of the counter-edge portions have semicircular recesses, or, as shown in FIG. 2*c*, slot-like recesses 20 can be provided on the rim or slot-like perforations 22 can be provided in the solid part of the counter-edge portions. Such different outline with the same thickness of the counter-edge portions give different spring characteristics, and this is necessary in order to obtain adaptation to different sheet metal grades: for the same sheet metal thickness, the counter-edge portions for stainless steel should be substantially stiffer than, for example, for aluminum.

It should be noted here that provision must also be made for different thicknesses of the metal sheets to be joined, by making the "depth" of the female die, that is to say the dimension between the counter-edges and the highest point of the anvil, approximately equal to the sum of the thicknesses of the two metal sheets, minus an amount of between 10% and 60%, preferably 30%. It will be seen that, with the counter-edge portions remaining the same, it is only necessary to exchange the anvil components in order to obtain tool sets for different metal sheet thicknesses. The most advantageous depth for a particular case can be preset in a reproducible manner either by limiting the press stroke or, and this is frequently a simpler solution, by limiting the force exerted by the press.

It is also possible to vary the shape of the longitudinal section of the spring, instead of the outline. Thus, according to FIG. 3*a*, a stacked pile of leaf springs which are, for example, exchangeable can be used in place of a solid counter-edge portion; it will be seen that only the innermost leaf springs 24 are rivetted to the anvil and form the actual counter-edge, while the remaining leaf springs are exchangeable and the entire pack is inserted into a holding block 26.

As shown in FIG. 3*b*, the two counter-edge portions can also be formed, together with a foot 28, as an integral component cut to length from a strand, the anvil being inserted into the curve of the U-shaped profile.

The adaptation of the counter-edge portion cross-section to the most advantageous deformation characteristics was effected according to FIGS. 2*a*–2*c* by varying the width of the counter-edge portions. However, it is also possible to vary the thickness of the counter-edge portions according to FIG. 3*c*, approximately the same characteristics being obtained as with the spring packs according to FIG. 3*a*.

The anvil part 30 according to FIG. 4*a* does not have the rhomboid cross-section as indicated in FIG. 1, but has a simple rectangular cross-section in the middle zone. Instead, a roof-like slope 32, along which the chips are discharged to the outside is provided on the foot side.

Figure 4C:
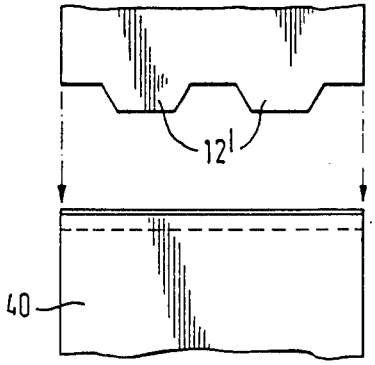
Figure 4B:
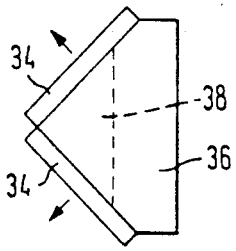

As indicated in FIG. 4*b*, the two counter-edge portions do not have to be in parallel positions; they can also be in positions meeting at a corner and form the female die together with a "corner anvil" 36: the cross-section of the punch 38 then has the form of an isosceles rectangular triangle.

Another variant, not shown, of the female die has counter-edges which, although parallel to one another, are not located on the edge or rim opposite the clamping or supporting point, but on a side edge running perpendicular thereto. This means that the clamping point of the springs is not located, as in all the other embodiments, essentially underneath the male die, but laterally thereof and that accordingly the space underneath the male die can be fairly constricted. The fact that the conditions in the longitudinal direction of the cuts are altered, because the two ends of the female die spring up to different extents, has proved to be not a disadvantage.

According to FIG. 4*c*, it is also possible for two punches 12' to run with a common female die 40 together in one and the same press; in this case each stroke produces two joint areas simultaneously, the resistance to formation of the joint being greater than that of a single joint of a correspondingly enlarged cross-section.

Figure 4D:
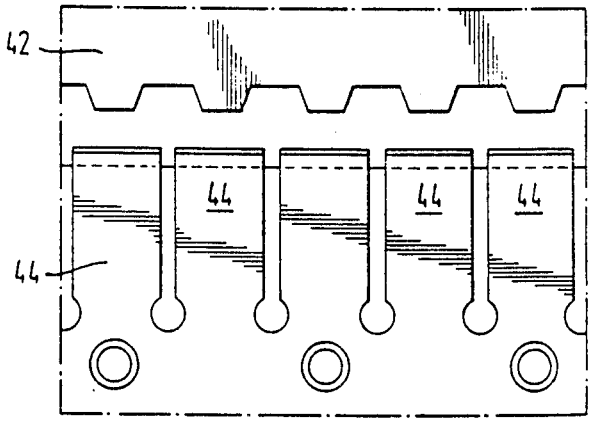

It is even possible, as indicated in FIG. 4*d*, to cut a male die strip 42 as well as anvil cutting edge portion strips 44 of any desired length from starting material of appropriate profile and then to insert these into corresponding holding strips which can be fitted to conventional presses—say folding presses.

Figure 4E:
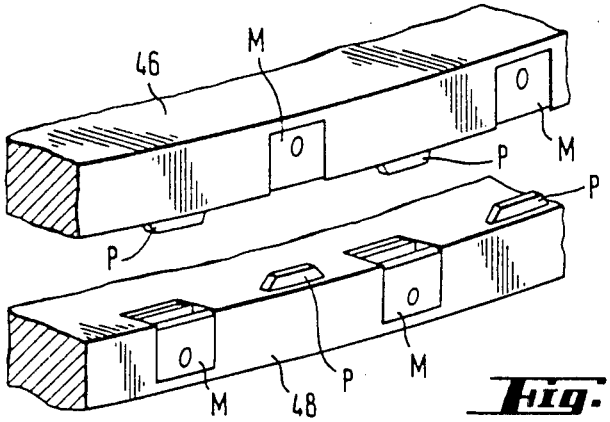

FIG. 4*e* perspectively shows a section of a complete tool, fitted with male dies P and female dies M. It will be seen that the upper tool 46 and lower tool 48 contain both female dies and male dies; to prevent the metal sheets to be joined from nevertheless being stressed or even distorted, the distance of the counter-edges of the upper and lower tools is equal to the thickness of the two metal sheets to be joined, when the tool is closed—that is to say in the final deformation position.

Figure 5A:
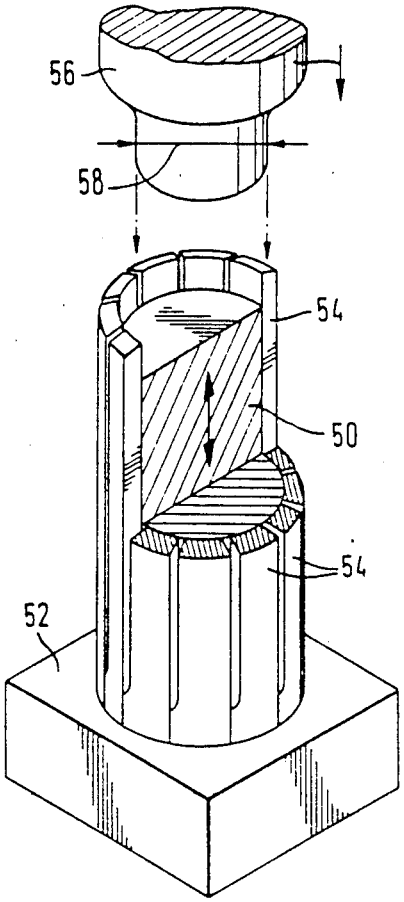
FIG. 5*a* shows a partially cut, perspective view of a further embodiment of male die and female die.

FIG. 5*a* shows an embodiment in which the anvil 50 has the shape of a circular cylinder, the height of which above a base 52 can be variably adjusted in the direction of the arrow by means of adjustment screws. The counter-edge portions 54 have the shape of hollow cylinder sectors or barrel staves which—except for the separating slots between them—completely surround the anvil. The separating slots can be present in various numbers and can have different slot widths. On the base side, the counter-edge portions 54 are inserted or clamped into corresponding recesses in the base 52. The counter-edge portions can be produced by slotting a sleeve or they can consist of individual segments.

There are two possibilities for the punch 56 in the form of a simple circular cylinder. In the first case, the cross-sections of the anvil 50 and punch 56 are substantially congruent. In this case—as in the embodiments described above—both the metal sheets are cut through, and the patches of material forced through still hang on the surrounding metal sheet only in the zone of the slots between the counter-edge portions. In the zone of the female die slots, the punch can be provided with recesses, to avoid constriction of the remaining connecting ridges.

In this respect, the outline shape of the joint differs from that in FIGS. 1 to 4*a* or 4*b*. If, however, a punch with cross-sectional dimensions 58, which are reduced by about twice the thickness of the metal sheet forced through, as compared with the homologous dimensions of the anvil, is selected, the metal sheet is, although forced through, not incised so that, in the finished joint, it sits in the other metal sheet in the manner of a press stud. Such a design makes it possible for the joint area to remain fluid-tight.

Figure 5B:
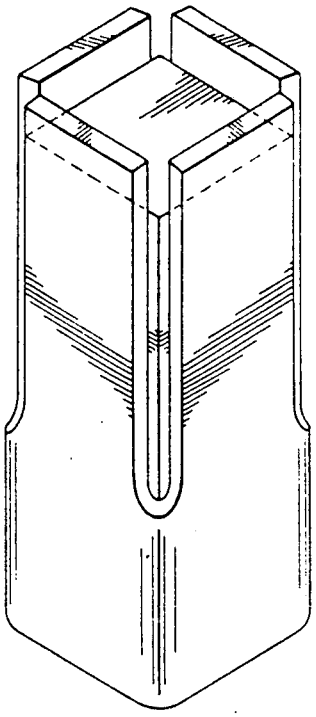
FIG. 5*b* shows a female die similar to that according to FIG. 5*a;*

The circular cylindrical shape is of course not at all indispensible, and other polygonal outlines are likewise conceivable, say a square or a hexagon (see FIG. 5*b* for the female die of a square joint area).

Figure 6:
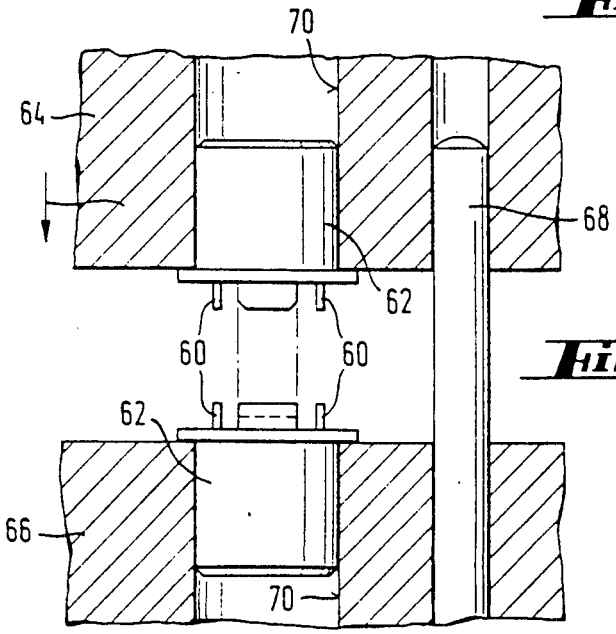
FIG. 6 serves to illustrate a preferred application of the device.

The fabrication of complete tools according to FIG. 4*e* can be realized, if a design corresponding to FIG. 6 is selected.

A female die with ejectors 60—for example in the form a spring-loaded pins—and an associated male die with ejectors 60 are in each case mounted on circular bases 62 of identical diameter. However, the ejectors can also be arranged nearby, independently of the female or male dies. A male die plate 64 and a female die plate 66 are provided with column guides 68 and thus put in reproducible positions relative to one another. The two plates are then together drilled through at the appropriate points, and the bases 62 are then inserted into the bores 70 which are thus necessarily aligned, the bases then being turned into a desired angular position and being fixed in the latter. Damaged male dies or female dies can then be exchanged with only a few manipulations.

As an example, FIG. 7 shows a hand-held device, fitted with a male die 80 and a female die 82. The male die jaw 86 is hinged to the female die jaw 84 by means of a bearing bolt 88, and the cylinder body 90 of a high-pressure hydraulic cylinder is inserted into a recess in the female die jaw, the ram 92 of the hydraulic cylinder actuating the male die jaw in the manner of a press stroke. The return into the original position is effected by the tension spring 94.

Such a pliers-like design of the device has the great advantage that little space is required above and below the joint area, and the joint can also be made in poorly accessible positions. The fact that the relative motion of the male and female dies is then no longer along a straight line, but along a circular arc—which may even have a relatively small radius—surprisingly does not impair the usefulness of the device. Moreover, the drive by hydraulic cylinder is not absolutely necessary; in fact, since straight guiding is not indispensible, a force-gearing lever linkage can be provided which makes even manually actuated devices possible.

FIG. 8 shows an embodiment in which the male dies "P" and the female dies "M" are in each case provided on the periphery of a disk 70 and 72 respectively, which are rotatable in the direction of the arrows. This is therefore not a press in the usual sense of the word, but the two tool components are brought by the rotary drive into interaction with one another and with the metal sheets 74, 76. In the lefthand part of FIG. 8, the joint just made can be seen at 78.

The disks are each seated on the ends of shafts in floating mounts, driven synchronously by a motor. Between the male die/female die combinations coming into engagement at any one time, the disks can be coated with a material promoting friction, for example, they can have a soft rubber coating or they can be provided with knurling.

Figure 9A:
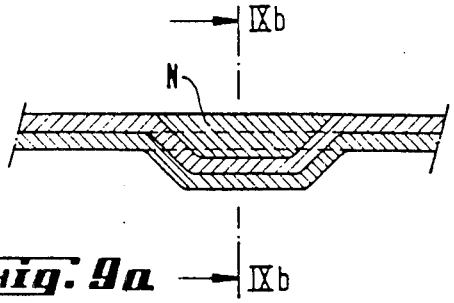
FIGS. 9*a* and 9*b* show, in longitudinal section and cross-section respectively, joints of two metal sheets, in which an invert component in the manner of a rivet is provided.
Figure 9B:
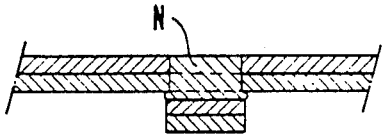

Occasionally, it will be desirable to close the depressions formed by the joining process on the male die side of the joined metal sheets. This can be effected as early as the joining process, and FIGS. 9*a* and 9*b* show a rivet-like insert N or plug component in two mutually perpendicular sections through such a joint. In a manner of speaking, this plug component represents the tip of the male die, which has remained in the joint and, in this connection, provides the cutting edges which interact with the leaf spring counter-edges.

Figure 10:
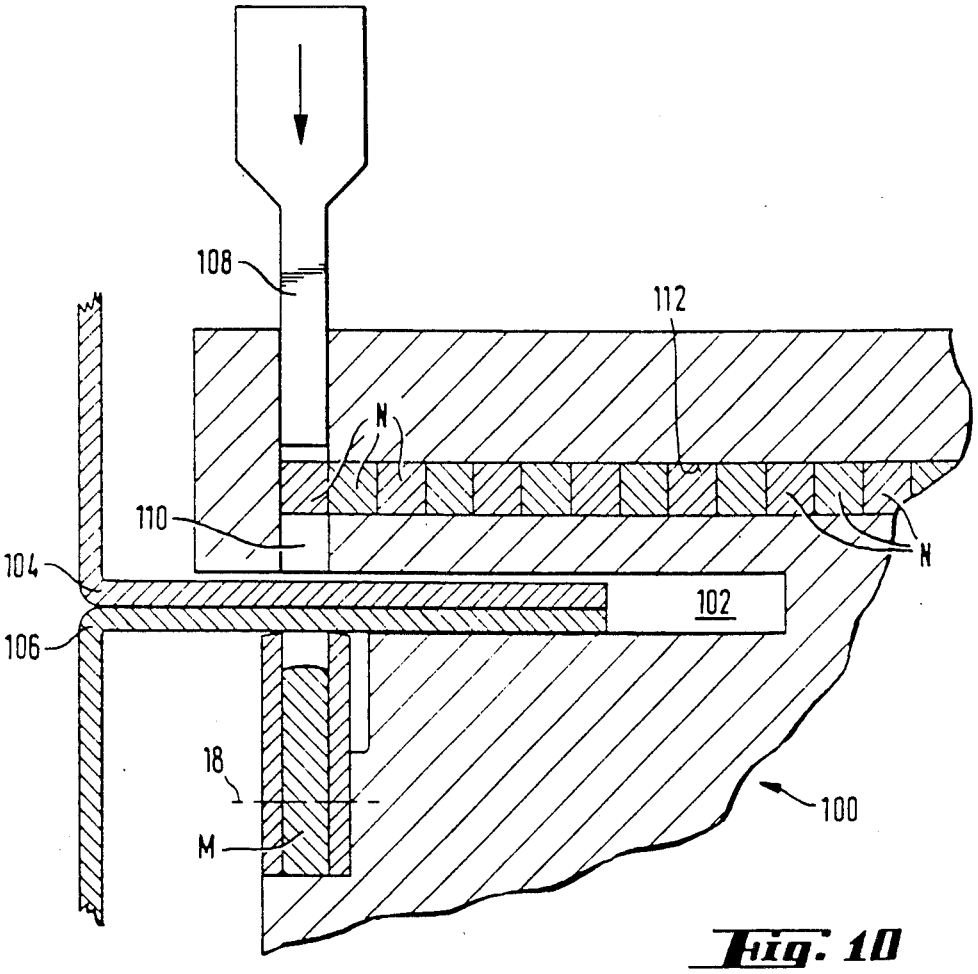
FIG. 10 shows, in section and largely diagrammatically, a device for making the joint according to FIGS. 9*a* and 9*b*.

FIG. 10 shows, in section and largely diagrammatically, a device, by means of which such a joint can be produced.

In a lower tool 100, the female die M is arranged in the customary manner. Above it, a slot 102 is formed into which the metal sheets 104, 106 which are to be joined fit with play. Above the female die, the lower tool has a guide channel 110 for the upper tool 108. A recess 112 serving as a magazine for the rivet N leads into this channel 110 and runs transversely to the latter. The means for moving the stack of rivets in the recess 112 forward are familiar to those skilled in the art and are therefore not shown here.

Alternatively, it is also possible to insert an extruded profile cut to length into the recess, the upper tool having an auxiliary cutting edge to cut a rivet plug off the profile at each press stroke.

It must be pointed out that the expression "metal sheet" used above comprises not only thin sheet (less than 2 mm thick) or medium sheet (less than 4 mm thick), but also plate, for example aluminum 5 mm thick. Likewise, it should be noted that parts of extruded or other profiles are also to be understood as "metal sheet" in the sense of the invention. Thus, for example, a framework of U-profiles can be joined to sheet facing with the aid of the subject of the invention. And finally, it remains to be said that the two metal sheets (in the above sense) to be joined do not at all have to be of the same thickness, or that they may consist of different materials; thus, for example, an aluminum sheet 3 mm thick can readily be joined to a stainless steel sheet 1 mm thick.

What we claim is:

1. In a device for joining two metal sheets by inserting the same face-to-face between a female die and a male die which can be moved in the direction if the female die, and in which the male die comprises a punch provided with cutting edges and the female die comprises counter-edges and an anvil which is set back behind the counter-edges and on which the material forced between the counter-edges by the punch is pressed to flow while the counter-edges yield laterally and, after the joint has been lifted out of the female die, are returned again into their cutting position by means of spring tension; characterized in that said counter-edges are formed by the free edges of leaf springs which extend generally parallel to the direction of movement of the male die, said leaf springs having uniform thickness in the lateral yielding direction and are secured rigidly relative to said anvil to prohibit vertical sliding movement therebetween and so as to be in flat, mutual contact therewith at the area of securance, said leaf springs withstanding the cutting force of said punch in the direction of its movement toward said anvil and are capable of flexing between said counter-edges and said rigid securance in a direction orthogonal to said direction of punch movement.

2. A device as claimed in claim 1, wherein the leaf springs have a rectangular cross-section and are rigidly joined to the anvil of likewise rectangular cross-section.

3. A device as claimed in claim 1, wherein the leaf springs have a cross-section in the form of a sector of a circular ring and are rigidly joined to an anvil having a circular cross-section.

4. A device as claimed in claim 1, wherein the leaf springs have a bending stress which increases in the direction of the counter-edges.

5. A device as claimed in claim 1, wherein the leaf springs have lateral recesses.

6. A device as claimed in claim 1, wherein the leaf springs have perforations.

7. A device as claimed in claim 2, wherein a metal chip-collecting space is formed between the anvil and the leaf springs.

8. A device as claimed in claim 7, wherein the chip-collecting space is formed by undercuts in the anvil.

9. A device as claimed in claim 1, wherein the cutting edges provided to interact with the leaf spring counter-edges are formed on a plug component which remains between said leaf springs.

10. A device as claimed in claim 9, wherein said plug component can be sheared off from a strand of material by means of an auxiliary cutting edge formed on the male die.

11. A device as claimed in claim 1, which comprises a plurality of male/female die combinations in an upper tool and lower tool, each of which combinations includes free edges of leaf springs providing said counter-edges.

12. A device as claimed in claim 11, wherein the upper and lower tools each carry both male dies and female dies.

13. A device as claimed in claim 12, wherein, in the position of closest approach of the two tools, the counter-edges of the female dies of both tools are at a mutual distance which is at least approximately equal to the thickness of the sheets which are to be joined.

14. A device as claimed in claim 1, which comprises elastic ejectors for detaching the sheets from the male and female dies.

15. A device as claimed in claim 14, wherein in each case one female die or one male die arranged together with an ejector on a base form an assembly group.

16. A device as claimed in claim 15, wherein the bases are cylindrical and are exerted into bores in the upper or lower tool.

17. device as claimed in claim 1, wherein the punch and the female die are each fixed to the free end of a lever arm, the two lever arms being pivotable about a common pivot in order to force the punch and female die against each other.

18. A device as claimed in claim 17, wherein a hydraulic actuating cylinder is provided as the drive for the two lever arms pivoting relative to one another.

19. A device as in claim 1, wherein said device has an end region facing said punch, said leaf springs and said anvil lie in flat, mutual contact in the end region facing said punch.

20. A device as in claim 1, wherein the bending stress of said leaf springs proportionally increases along the length thereof from the counter-edges toward the point of attachment to said anvil.

21. In a device for joining two metal sheets by inserting the same face-to-face between a female die and a male die which can be moved in the direction of the female die, and in which the male die comprises a punch provided with cutting edges and the female die comprises counter-edges and an anvil which is set back behind the counter-edges and on which the material forced between the counter-edges by the punch is pressed to flow while the counter-edges yield laterally and, after the joint has been lifted out of the female die, are returned again into their cutting position by means of spring tension; characterized in that said counter-edges are formed by the free edges of leaf springs which extend generally parallel to the direction of movement of the male die, said leaf springs having uniform thickness in the flexing directing and are secured rigidly relative to said anvil so as to be in flat, mutual contact therewith at the area of securance, said leaf springs withstanding the cutting force of said punch in the direction of its movement toward said anvil and are capable of flexing between said counter-edges and said rigid securance in a direction orthogonal to said direction of punch movement, wherein the leaf springs have a bending stress which increases in the direction of the counter-edges, wherein a stacked pack of individual laminae are positioned outwardly of said leaf springs.

22. In a device for joining two metal sheets by inserting the same face-to-face between a female die and a male die which can be moved in the direction of the female die, and in which the male die comprises a punch provided with cutting edges and the female die comprises counter-edges and an anvil which is set back behind the counter-edges and on which the material forced between the counter-edges by the punch is pressed to flow while the counter-edges yield laterally and, after the joint has been lifted out of the female die, are returned again into their cutting position by means of spring tension; characterized in that said counter-edges are formed by the free edges of leaf springs which extend generally parallel to the direction of movement of the male die, said leaf springs having uniform thickness in the flexing direction and are secured rigidly relative to said anvil so as to be in flat, mutual contact therewith at the area of securance, said leaf springs withstanding the cutting force of said punch in the direction of its movement toward said anvil and are capable of flexing between said counter-edges and said rigid securance in a direction orthogonal to said direction of punch movement, wherein the bending stress of said leaf springs proportionally increases along the length thereof from the counter-edges toward the point of attachment to said anvil further including at least one additional leaf spring stacked vertically against said rigidly secured leaf spring and retaining means for retaining said at least one additional leaf spring in the stacked position.

23. A device as in claim 22, wherein said at least one additional leaf spring is removably retained.

24. A device as in claim 22, wherein said vertical stack includes a plurality of additional leaf springs with the vertical dimension of each of said plurality of additional leaf springs being proportionally less than the next innermost leaf spring in the vertical stack.

* * * * *